US005449406A

United States Patent [19]

Presti, Jr.

[11] Patent Number: 5,449,406

[45] Date of Patent: Sep. 12, 1995

[54] GROUTING MACHINE

[76] Inventor: Francis A. Presti, Jr., 5120 Lisch Dr., Whitmore Lake, Mich. 48189

[21] Appl. No.: 328,162

[22] Filed: Oct. 24, 1994

[51] Int. Cl.[6] ..... B05C 1/00

[52] U.S. Cl. ..... 118/264; 118/244; 118/258; 222/611.2; 401/48; 404/112

[58] Field of Search ..... 118/244, 258, 264; 401/48; 404/407, 111, 112; 222/611.2, 548; 427/271, 277

[56] References Cited

U.S. PATENT DOCUMENTS

| | | | |
|---|---|---|---|
| 2,556,983 | 6/1951 | Root | 404/112 |
| 2,662,454 | 12/1953 | Whiteman | 404/112 |
| 2,963,059 | 12/1960 | Grub | 144/115 |
| 3,239,871 | 3/1966 | Le Mieux et al. | 401/15 |
| 3,296,946 | 1/1967 | Cagno | 404/112 |
| 4,781,556 | 11/1988 | Paul | 425/62 |
| 5,372,452 | 12/1994 | Hodgson | 404/112 |

*Primary Examiner*—W. Gary Jones
*Assistant Examiner*—Laura E. Edwards
*Attorney, Agent, or Firm*—Cahill, Sutton & Thomas

[57] ABSTRACT

A machine for applying grout mortar to a tiled surface includes a rotatable, frustroconical shroud having a plurality of generally radially extending blades therein. Resilient foot pads positioned at the bottom edges of the shroud and the blades contact the tiled surface. Each of the blades preferably is curved so that its outer end precedes its inner end in the direction of rotation of the shroud. Each blade also is tilted so that the upper edge is ahead of the its lower edge in the direction of rotation of the shroud.

5 Claims, 1 Drawing Sheet

GROUTING MACHINE

TECHNICAL FIELD

This invention is concerned with the mechanized application of grout mortar to crevices between stones, bricks, tiles, and the like positioned on a surface.

BACKGROUND ART

In the traditional method of applying grout mortar to ceramic floor tile, a thin mortar is squeegeed into the crevices with a hand-held, rubber-faced trowel. Excess mortar is then washed from the surface of the tile with a wet sponge before the mortar completely dries.

This grouting technique is entirely acceptable for small surface area. However, it is labor-intensive and time-consuming for large tiled areas.

In the past, motor-driven rotary trowels have been employed to impart the desired finish surface to concrete floors. U.S. Pat. No. 2,556,983, granted Jun. 12, 1951, to W. J. Root for "CEMENT FINISHING FLOAT BLADE", and U.S. Pat. No. 2,662,454, granted Dec. 15, 1953, to M. E. Whiteman for "FLOAT TROWEL FOR CEMENT FLOOR FINISHERS" disclose machines useful for this purpose. Neither of these patents makes reference to the application of grout.

Somewhat similar apparatus is disclosed in U.S. Pat. No. 2,963,059, granted Dec. 6, 1960, to R. Grub for "APPARATUS TO SMOOTH FLOORING". This apparatus employs flexible metal blades depending from a rotating disk to smooth a floor coating. The patent contains no indication that the apparatus would be useful in troweling grout onto a tiled surface.

Machines have also been devised for the controlled application of a thin, protective coating to a flat surface. U.S. Pat. No. 3,239,871, granted Mar. 15, 1966, to R. W. LeMieux, et al. for "APPLICATOR APPARATUS" discloses such a machine for finishing and refinishing bowling alleys. The machine does not appear suitable for grouting tile.

There continues to be a need for a motorized tile grouting machine capable of rapidly grouting large surface areas.

DISCLOSURE OF THE INVENTION

This invention provides a machine which is capable of depositing mortar at a controlled rate onto a tiled surface and uniformly troweling the mortar into the crevices between the tiles. The machine is comprised of a motor-driven frustroconical shroud having a plurality of upstanding and generally radially extending blades positioned therein. Resilient foot pads positioned at the bottom edges of the shroud and the blades contact the tiled surface, compensate for irregularities in the surface and trowel the mortar into the crevices. These blades are preferably curved so that the outer edges of the blades precede their inner edges and the blades are tilted so that the upper edges precede the lower edges as the shroud is rotated. A cylindrical funnel atop the shroud receives mortar from a hopper positioned above and delivers the mortar to the interior of the shroud through openings in the top of the shroud.

BRIEF DESCRIPTION OF THE DRAWINGS

The invention is described in greater detail hereinafter by reference to the accompanying drawings, wherein.

BEST MODE FOR CARRYING OUT THE INVENTION

Figure 1:
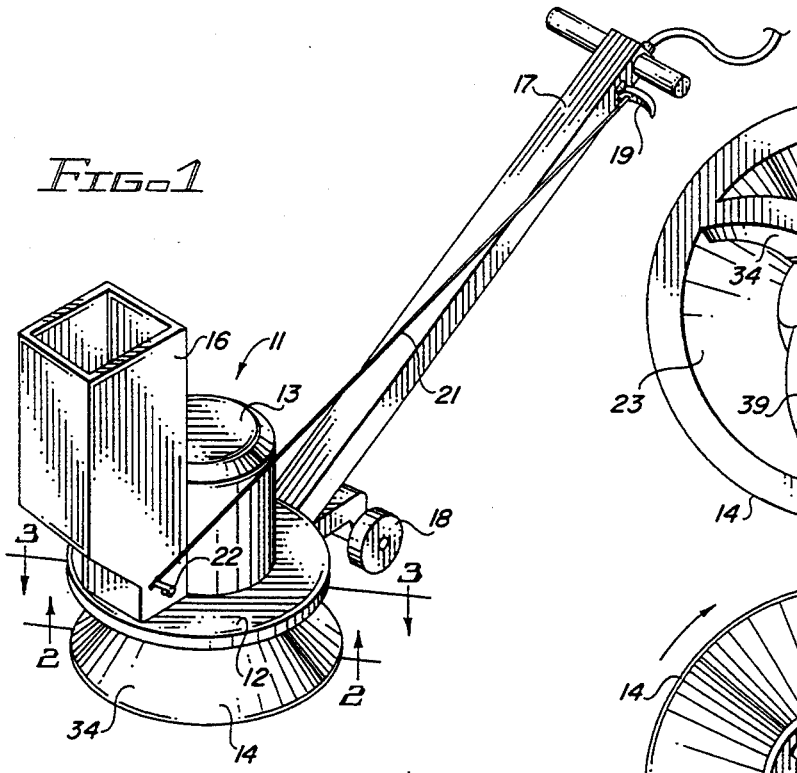
FIG. 1 is a perspective view of a grouting machine embodying the invention.

The grouting machine illustrated in FIG. 1 is designated generally by reference numeral 11 and comprises a base 12 supporting a motor 13 for driving a rotary assembly 14. The base 12 also supports a grout mortar hopper 16.

The machine 11 is manipulated by an operator through an elongated handle 17 affixed to the base 12. A pair of wheels 18 affixed to the rear of the base 12 facilitate moving the machine between periods of use.

Handle 17 is preferably equipped with a mortar feed control lever 19 which is attached by a cable 21 to a mortar control valve 22 positioned in the bottom of hopper 16.

Figure 2:
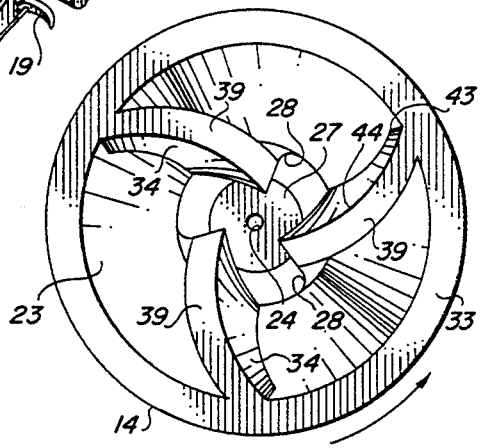
FIG. 2 is a bottom view of a rotary assembly employed in the machine.
Figure 3:
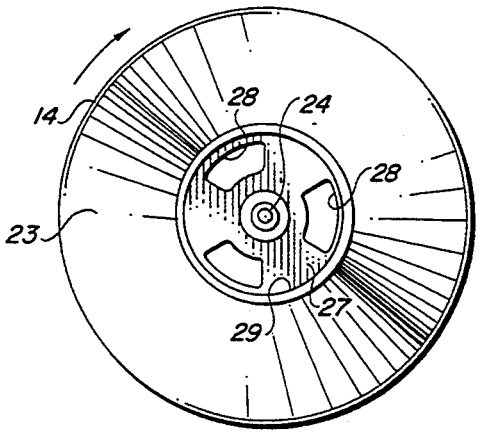
FIG. 3 is a top view of the rotary assembly.
Figure 4:
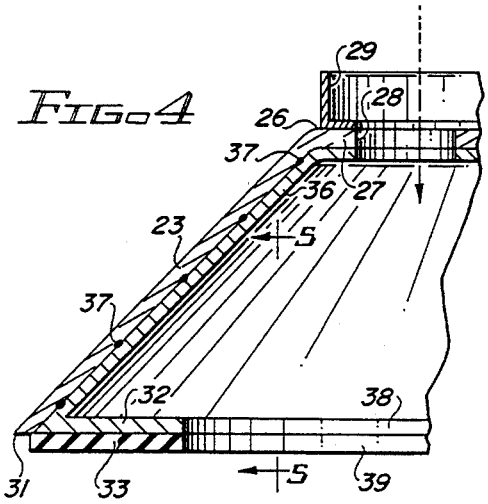
FIG. 4 is an enlarged sectional view through a wall of the assembly, taken generally as indicated by line 4—4 in FIG. 3.

Application of grout mortar to a tiled surface is effected by the rotary assembly 14, the construction of which is illustrated in FIGS. 2–4. The assembly comprises a frustroconical shroud 23, preferably made from corrosion-resistent metal. The shroud may be fabricated from sheet metal or formed by casting. Shroud 23 is rotated about a vertical axis by a shaft 24 connected to a gear reduction unit (not shown) which is driven by motor 13.

At the top edge 26 of shroud 23, there is a cover plate 27 having a series of openings 28 therein through which mortar is fed to the interior of the shroud. A cylindrical funnel 29 positioned atop the shroud 23 catches mortar released from hopper 16 and directs the mortar into shroud cover plate openings 28.

At the bottom edge 31 of shroud 23 is an interned flange 32 that carries a circular resilient foot pad 33. The outside diameter of foot pad 33 is substantially the same as the diameter of the bottom edge 31 of shroud 23. The width of foot pad 33 is substantially the same as the width of the shroud flange 32.

Rotary assembly 14 further includes a plurality of generally radially extending blades 34 positioned inside shroud 23. In the preferred mode, there are three equiangularly disposed blades 34 as shown in FIG. 2. Each blade 34 is preferably fabricated from corrosion-resistent sheet metal.

Figure 6:
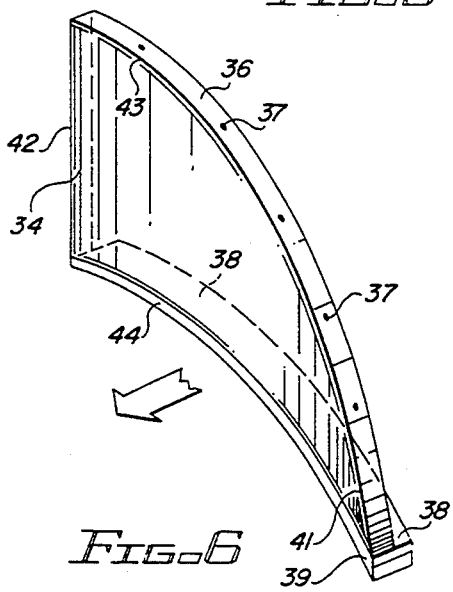
FIG. 6 is a perspective view of a blade member employed in the machine.
Figure 5:
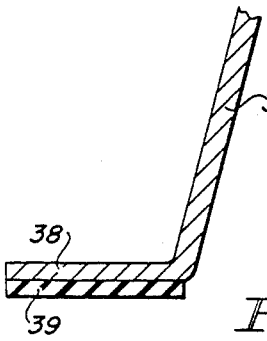
FIG. 5 is an enlarged sectional view of a portion of a blade member taken generally as indicated by line 5—5 in FIG. 4.

Each blade 34 has a flange 36 (see FIGS. 4 and 6) along its upper edge by which it is secured as by spot welds 37, to the cover plate 27 and the side wall of the shroud 23. Each blade 34 also has a flange 38 along its bottom edge for carrying an elongated resilient foot pad 39. (See FIG. 5).

The bottom edges of the flange 38 of the blades 34 lie in substantially the same plane as the flange 34 and bottom edge 31 of the shroud 34. Thus, resilient foot pad 33 and resilient foot pads 39 all lie in the same plane and uniformly contact the tiled surface on which the rotary assembly 14 rests.

Foot pads 33 and 39 are preferably made of rubber or plastic rubber-like materials.

The blades 34 in shroud 23 are preferably configured to retain the grout mortar within the confines of the shroud and to trowel, or squeegee, the mortar down into the crevices between the tiles. For the former purpose, each blade 34 is curved forward so that the outer end 41 leads the inner end 42 in the direction of rotation of the shroud 23 (see FIGS. 2 and 6). For the latter purpose, each blade is canted, or tilted, so that the upper edge 43 of the blade leads the lower edge 44 in the direction of rotation of the shroud 23 (again see FIGS. 2 and 6).

In operation, with the rotary assembly 14 being turned by motor 13, the operator moves mortar feed control lever 19 to release a controlled quantity of grout mortar from hopper 16 into the rotary assembly. The operator adjusts the quantity of mortar being applied to the rotary assembly 14 so that when the machine has been moved over an area of tiled surface, all crevices in that area are completely filled and only a light haze of mortar remains on the face of the tile. This residue can easily be wiped away later with a damp sponge.

From the foregoing, it should be apparent that this invention provides an improved machine for grouting tiled surfaces. And, while numerous references have been made herein to the use of the machine on tiled surfaces, it should be apparent that the machine is useful in treating other similar surfaces, such as those formed by stones, bricks, ceramic chips, and the like.

What is claimed is:

1. A grouting machine comprising a frustroconical shroud having upper and lower edges and a vertical axis, means disposed on said shroud for the controlled deposit of grout mortar to an interior of said shroud, means connected to said shroud for rotating said shroud about its axis, a plurality of generally radially extending upright blades positioned in said shroud, said blades having lower edges in substantially the same plane as the lower edge of said shroud, a circular resilient foot pad secured to the lower edge of the shroud, and a resilient foot pad secured lengthwise of the lower edge of each of said blades.

2. The grouting machine of claim 1, wherein said mortar deposit means includes funnel means positioned atop said shroud and a hopper positioned above the funnel means.

3. The grouting machine of claim 1, wherein each of said blades has inner and outer ends and is curved forward so that the outer end of the blade leads the inner end in the direction of rotation of the shroud.

4. The grouting machine of claim 3, wherein each of said blades has both upper and lower edges and is positioned in the shroud in a manner that the upper edge of the blade leads the lower edge of the blade in the direction of rotation of the shroud.

5. The grouting machine of claim 1, wherein each of said blades has both upper and lower edges and is positioned in the shroud in the manner that the upper edge of the blade leads the lower edge of the blade in the direction of rotation of the shroud.

* * * * *